US009346312B2

(12) United States Patent
Busam et al.

(10) Patent No.: US 9,346,312 B2
(45) Date of Patent: May 24, 2016

(54) BINDER WITH REINFORCED SPINE

(75) Inventors: Edward P. Busam, Mason, OH (US); Michael D. Rowe, Medway, OH (US); James C. Matchett, Atlanta, GA (US); Keith D. McGoldrick, Oxford, OH (US); Jason M. Kramer, Beavercreek, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 547 days.

(21) Appl. No.: 13/606,697

(22) Filed: Sep. 7, 2012

(65) Prior Publication Data

US 2013/0084124 A1 Apr. 4, 2013

Related U.S. Application Data

(60) Provisional application No. 61/541,614, filed on Sep. 30, 2011.

(51) Int. Cl.

| | |
|---|---|
| ***B42D 3/06*** | (2006.01) |
| ***B42F 13/00*** | (2006.01) |
| ***B42D 3/00*** | (2006.01) |

(52) U.S. Cl.

CPC ..... *B42F 13/0013* (2013.01); *B42D 3/002* (2013.01); *B42D 3/06* (2013.01); *B42F 13/002* (2013.01); *B42F 13/004* (2013.01); *B42F 13/006* (2013.01)

(58) Field of Classification Search

CPC ... B42F 13/0006; B42F 13/002; B42F 13/004
USPC ..... 402/73, 76, 77; 412/3, 17, 31
See application file for complete search history.

(56) References Cited

U.S. PATENT DOCUMENTS

| | | | | |
|---|---|---|---|---|
| 788,033 | A | 4/1905 | Emerson | |
| 1,495,467 | A * | 5/1924 | White | B42D 3/02 281/29 |
| 2,772,427 | A * | 12/1956 | Rankin | 402/77 |
| 3,802,723 | A * | 4/1974 | Watson | B42C 11/02 281/27 |
| 4,856,817 | A | 8/1989 | Moor | |
| 5,106,222 | A | 4/1992 | D'Amore | |
| D344,540 | S | 2/1994 | Wyant | |
| 6,361,236 | B1 * | 3/2002 | Podosek | 402/73 |
| 7,399,136 | B2 | 7/2008 | Petrie et al. | |
| 7,717,638 | B2 | 5/2010 | Harris et al. | |

FOREIGN PATENT DOCUMENTS

| | | | |
|---|---|---|---|
| CA | 1221597 | * | 5/1987 |
| GB | 743168 | | 1/1956 |

* cited by examiner

*Primary Examiner* — Kyle Grabowski
(74) *Attorney, Agent, or Firm* — Thompson Hine LLP

(57) ABSTRACT

A bound component including a first panel and a second panel pivotally coupled together along a hinge. Each panel includes an outer covering and a substrate positioned in the outer covering, wherein the outer covering of the first panel is directly coupled to the outer covering of the second panel to form the hinge. The substrates of the first and second panels are not directly coupled together. The bound component further includes a reinforcement extending over or forming at least part of the hinge.

25 Claims, 5 Drawing Sheets

BINDER WITH REINFORCED SPINE

This application claims priority to U.S. Provisional Patent Application Ser. No. 61/541,614, entitled BINDER WITH REINFORCED SPINE, filed on Sep. 30, 2011, the entire contents of which are incorporated herein.

BACKGROUND

Binders are typically used in home, office and school settings to provide portable storage devices for holding various contents. The binders can have a spine, front and back covers connected to the spine and a binding mechanism attached to the spine, and be configured to store notebooks, papers, pencil/pen pouches or the like. In some cases the hinge areas of such binders, along the spine, can crack or split and eventually fail.

SUMMARY

In one embodiment, the present invention is a bound component including a first panel and a second panel pivotally coupled together along a hinge. Each panel includes an outer covering and a substrate positioned in the outer covering, wherein the outer covering of the first panel is directly coupled to the outer covering of the second panel to form the hinge. The substrates of the first and second panels are not directly coupled together. The bound component further includes a reinforcement extending over or forming at least part of the hinge.

Other objectives, advantages and features of the products disclosed herein will become more apparent from the following detailed description.

DETAILED DESCRIPTION

Figure 1A:
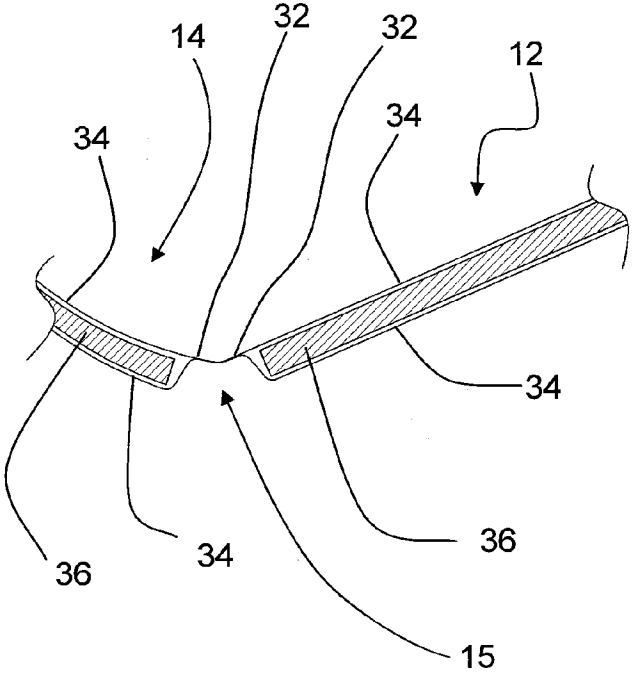
FIG. 1A is a cross section taken along the line indicated in FIG. 1.
Figure 1:
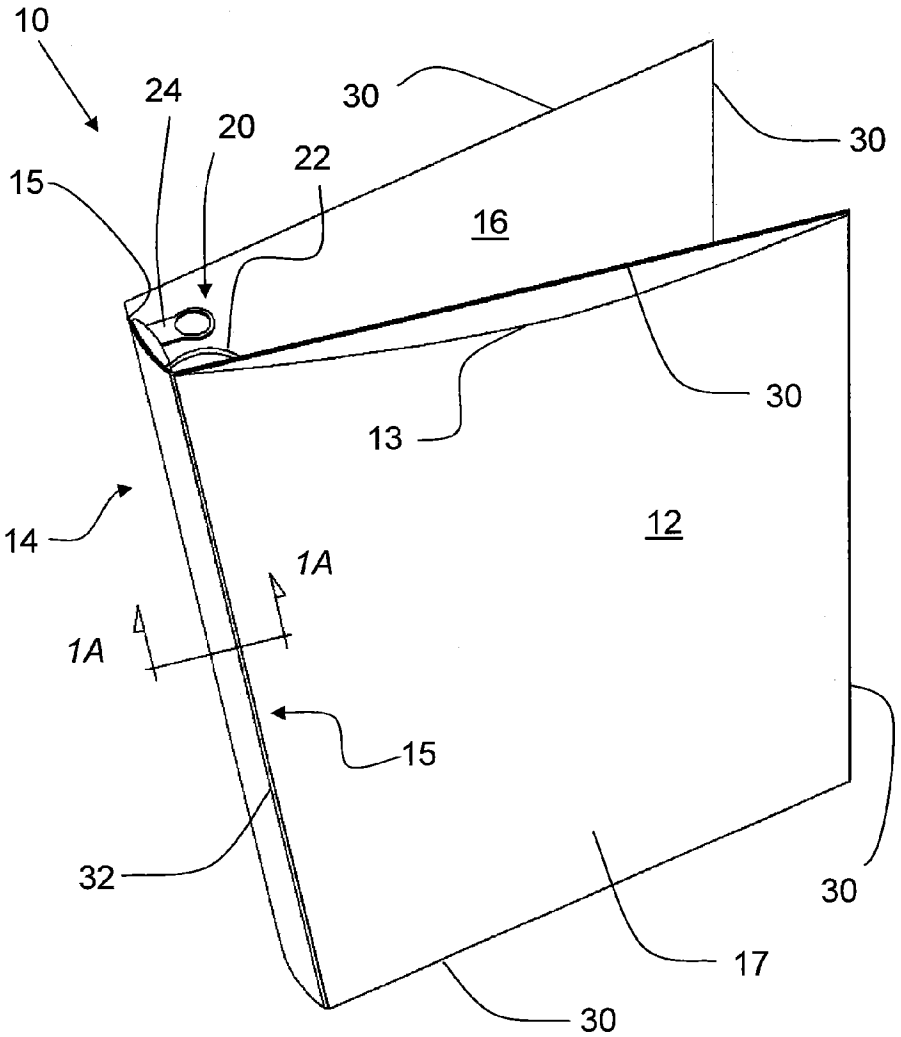
FIG. 1 is a top perspective view of a binder.
Figure 2:
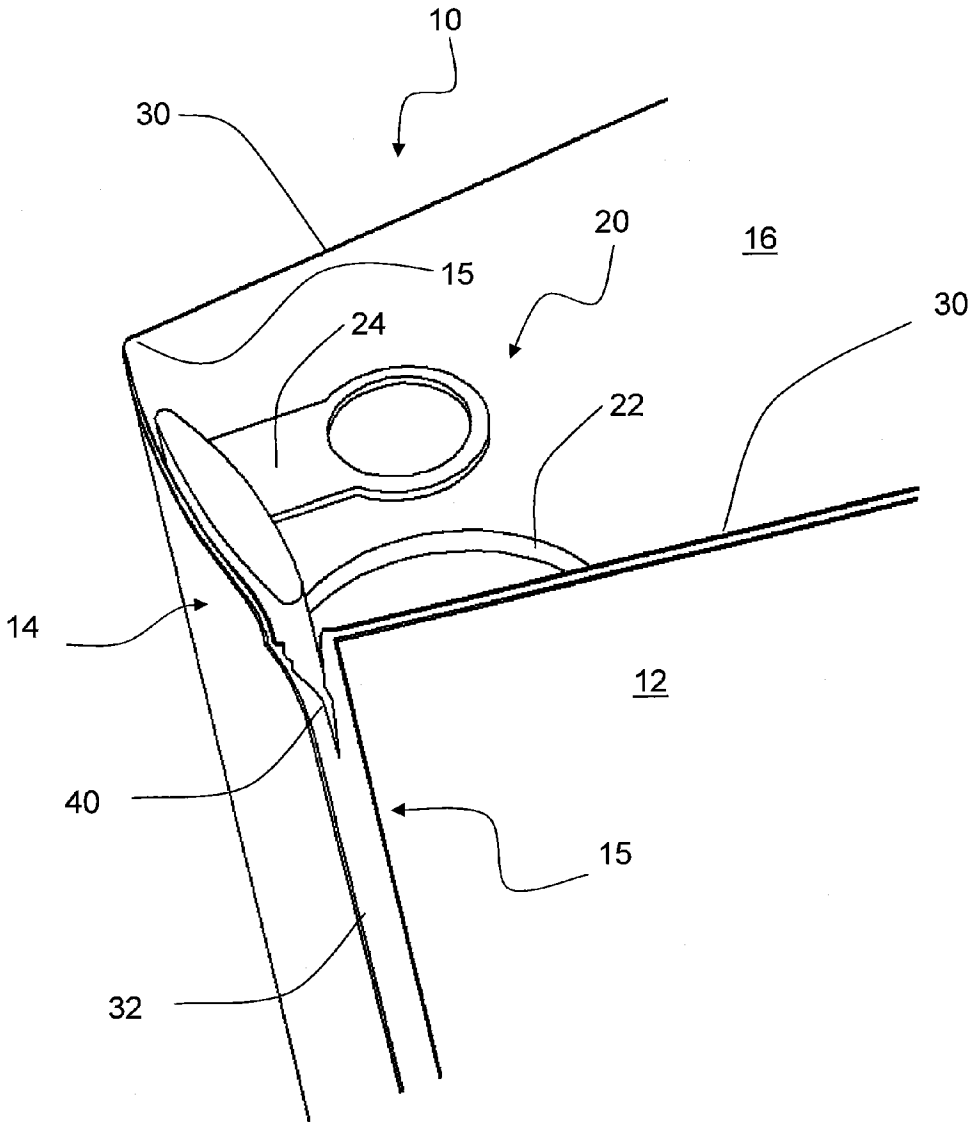
FIG. 2 is a top perspective view of the binder of FIG. 1 without a reinforcement, illustrating a split along the spine hinge.
Figure 3:
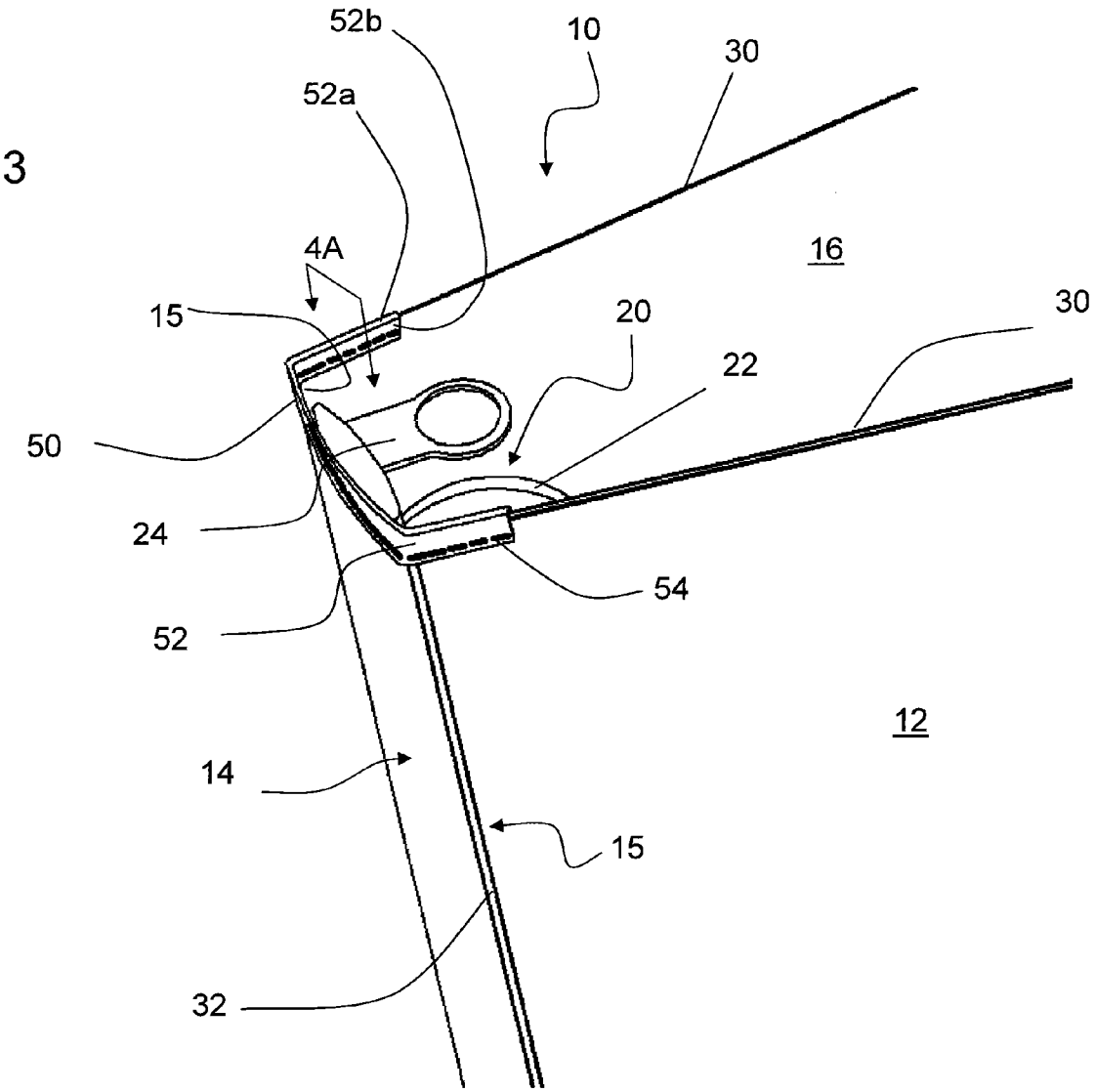
FIG. 3 is a top perspective detail view of a binder including a reinforcement.

As shown in FIGS. 1-3, in one embodiment a bound component, generally designated 10, may include a front cover 12, a spine 14, and a back cover 16 (the covers 12, 16 and spine 14 also being termed panels herein). The front cover 12 and back cover 16 may each be pivotally coupled to the spine 14 along an associated hinge or fold line 15, defining a hinge axis about which the covers 12, 16 can fold/pivot. The bound component 10 may also include a binding mechanism 20. In the illustrated embodiment the binding mechanism 20 is coupled to an inner surface of the spine 14, although the binding mechanism 20 could be coupled to any of the panels 12, 14, 16.

In the illustrated embodiment the binding mechanism 20 takes the form of a three-ring binder or the like, including one or more binding rings 22. Each binding ring 22 may be separable into two separate ring halves or portions such that papers or other items can be placed into, or removed from, the binding mechanism 20. Each binding ring 22 may also be movable to a closed position in which the ring halves engage each other and form a closed ring to trap the bound contents therein.

The binding mechanism 20 may include one or more actuators 24 that are manually operable to move the binding rings 22 between the open and closed position. However, the binding mechanism 20 can take any of a variety of other forms or configurations besides ring binding mechanisms, and can include or take the form of a coil or wire binding (including spiral and twin-wire bindings), brads, clips, cords, ribbon, elastic connectors, adhesives, book-style bindings, and combinations thereof, depending upon manufacturing preferences. The binding mechanism 20 may also take the form of the binding mechanisms shown in U.S. Pat. No. 7,717,638, the entire contents of which are hereby incorporated by reference.

It should be further understood that the bound component 10 need not necessarily include a binding mechanism 20 at all. In addition, the bound component 10 need not necessarily include the spine 14, in which case the covers 12, 16 can be directly pivotally coupled to each other. The bound component 10 can thus take the form of a binder, notebook, folder, folio, pocket, pocket divider, planner and the like. One or more pockets may be provided on the inner and/or outer surfaces of the front cover 12, back cover 16, and/or spine 14. For example, FIG. 1 illustrates a sheet of material 17 positioned on the outside of the front cover 12, where the sheet of material 17 forms a pocket 13 with the front cover 12.

The front cover 12, spine 14, and back cover 16 may each be made of a generally flat, planar material, with sufficient stiffness to retain their shape when the bound component 10 is stood upright/on end. For example, in one case the front cover 12, spine 14 and back cover 16 each include an inner substrate material 36 (shown in FIGS. 1A and 4A-4C) positioned between two or more layers of outer protective or decorative material 34. The inner material 36 can be made of any of a wide variety of materials, such as fiberboard, paperboard, cardboard, plastics, polymers or the like. The inner materials 36 may have a greater thickness and/or stiffness than the outer material 34 such that the inner material 36 provides the overall shape and thickness to the associated panel 12, 14, 16. The outer material 34 can provide a more durable, aesthetically pleasing, flexible/pliable or water resistant layer to the associated panel 12, 14, 16. The outer material 34 can be made of a variety of materials including plastics or polymers materials, sheets or film, including PVC, polypropylene, polyethylene, polyethylene vinyl acetate (PEVA), easy-processing polyethylene (EPPE), or other materials such as fabric, leather, or paper.

During manufacturing, a sheet of inner materials 36 can be positioned between two sheets of outer material 34 that each sheet of outer material 34 has a surface area/footprint greater than the associated sheet of inner material 36. The inner material 36 may have a surface areas that is at least about 90% of the surface area of the outer material 34/panel 12, 14, 16. In one case each sheet of inner material 36 is entirely captured/covered on all surfaces thereof by sheets of the associated outer material 34. The outer/perimeter edges of the outer material 34 may be joined together, sealing the inner material 36 therein and defining a fin or area 30, 32 extending outwardly beyond the associated inner material 36. The outer/ perimeter/fin materials can be formed/joined by any of a wide variety of methods, including by welding, fusing, adhering, crimping, sewing, stitching, rivets, stapling, gluing, or other methods according to manufacturing preference. The fin areas extending along the free edges of the panels 12, 14, 16 form or define perimeter seal areas 30 (FIGS. 4A, 4B, 4C), and the fin areas positioned between adjacent panels 12, 14, 16 form or define hinge seal areas 32 (FIG. 1A), which can be joined together to form hinges 15. In one embodiment the inner material 36 of the panels 12, 14, 16 are not directly coupled together, and the panels 12, 14, 16 are only coupled along the hinge seal areas 32.

During use of the bound component 10, the fin areas, particularly the hinge seal areas 32, may be subject to stresses when the bound component 10 is opened and closed, flexed, and otherwise stressed (e.g. compressed or sheared between other books or notebooks in a locker or backpack, etc.). Usage of the binding mechanism 20 (if present) may also put stress on the hinge seal areas 32. As a result, the hinge seal areas 32 may develop tears or cracks 40, particularly at the upper and/or lower ends of the hinges 15, as shown in FIG. 2. Such cracks 40 can be unsightly and may propagate along the hinges 15/hinge seal areas 32 to the extent that the panels 12/14/16 become loose or even entirely detached.

To strengthen the bound component 10 along the hinges 15/32, as shown in FIG. 3 the bound component 10 may include a reinforcement(s) 50 applied to all or part of the ends/free edge(s) of the spine 14 and/or portions of the front 12 and/or rear 16 covers, and/or along the top and/or bottom ends of the hinges 15/32. The reinforcement(s) 50 may include or take the form of a strip of material 52 such as fabric, plastic, paperboard, leather, or other materials, including the materials outlined above for the outer material 34 and/or substrate 36. The strip 52 can, in one case, be generally flat and rectangular when laid flat.

Figure 4C:
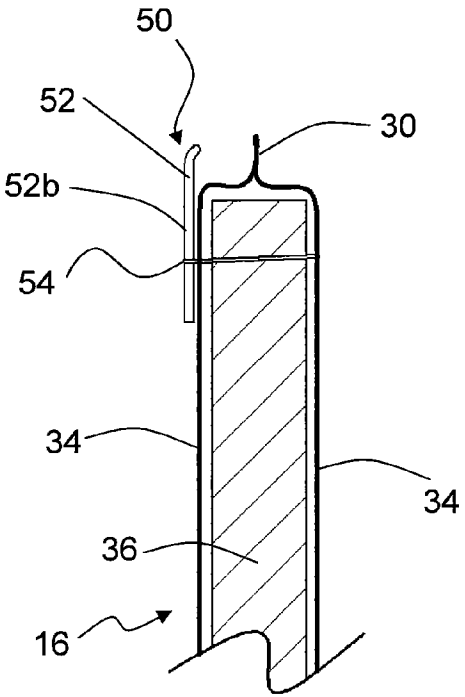
FIG. 4C is a cross section of yet another alternate reinforcement.
Figure 4B:
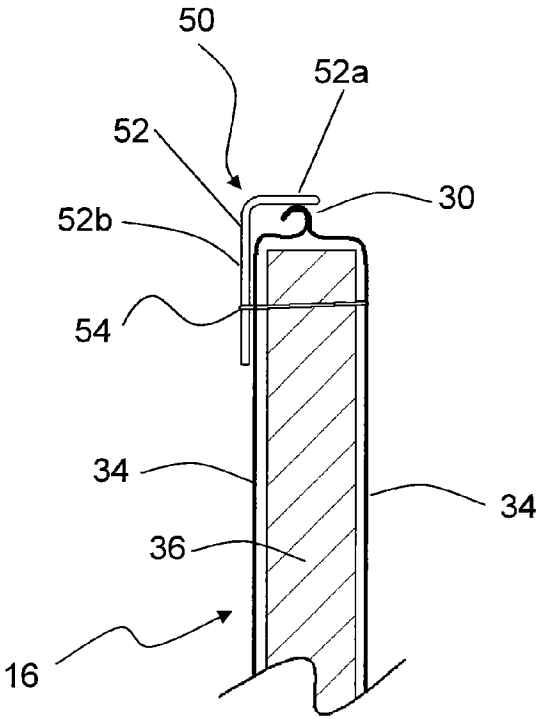
FIG. 4B is a cross section of an alternate reinforcement.
Figure 4A:
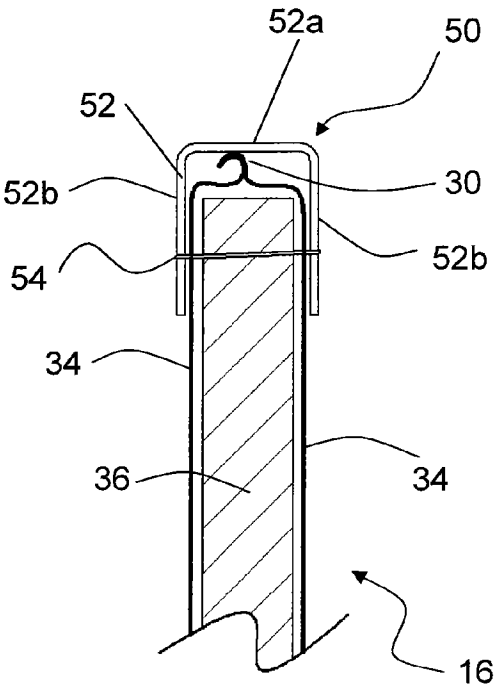
FIG. 4A is a cross section taken along the area indicated in FIG. 3.

As best shown in FIG. 4A, when coupled to the bound component 10 the strip 52 may be generally a U-shaped in cross section, having a base 52*a* extending along the top/bottom edge of the associated panel 12, 14, 16, and a pair of legs 52*b* positioned generally perpendicular to the base 52*a* and extending along on the inner and outer surfaces, respectively, of the associated panel 12, 14, 16. In the embodiment shown in FIG. 4A, the strip 52 somewhat deflects the underlying fin 30. In one case the fin 30 can be compressed generally flat along the upper edge of the panels 12, 14, 16, although the fin 30 need not necessarily be compressed/folded down.

In the embodiment shown in FIG. 3 the strip 52, or its longitudinal axis, is oriented generally perpendicular to the associated hinge 15/32. In addition, the strip 52 spans the associated hinge 15/32 such that part of the strip 52 is positioned on one side of the hinge 15/32, and another part of the strip 52 is positioned on the other side of the hinge 15/32. As can be seen in FIG. 3, the strip 52 may cover only upper part of the hinge areas 15/32 (i.e. the upper and/or lower portions thereof).

Figure 5:
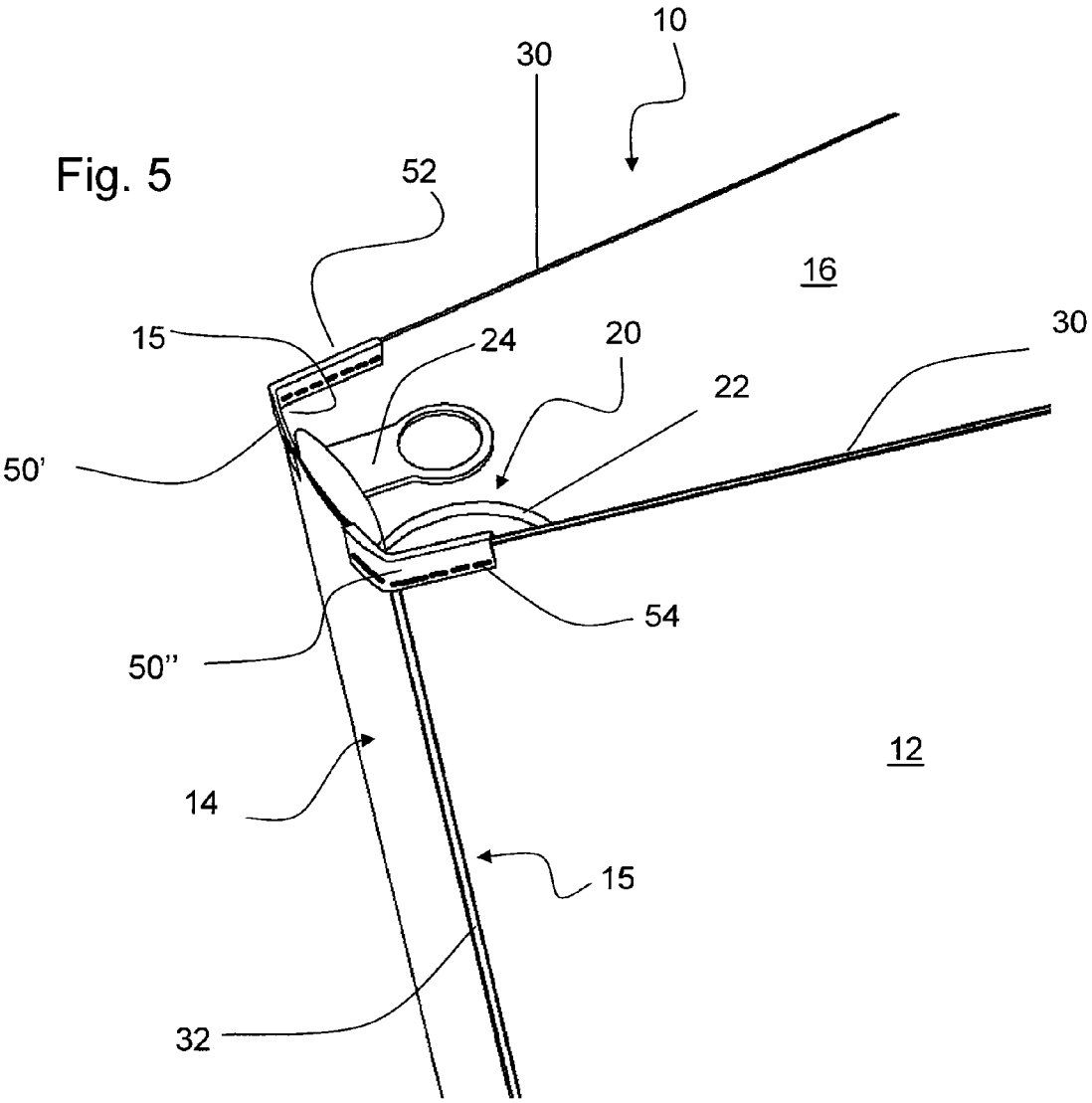
FIG. 5 is a top perspective view of a bound component including another embodiment of the reinforcement.

In the embodiment shown in FIG. 3, a single reinforcement 50/strip 52 spans part of both hinges 15/32, covering all of the upper free edge of the spine 14, and part of the front 12 and rear 16 covers adjacent to the spine 14. However, if desired, the reinforcement/strip shown in FIG. 3 can be divided into two sections 50', 50", as shown in FIG. 5. In this case the first section 50' covers/spans an upper end of one of the hinges 15/32, and the other portion covers/spans the upper end of the other hinge 15/32.

The reinforcement 50 can be secured in place by attaching the reinforcement 50 to itself and/or portions of the associated panels 12, 14, 16, including the covering material 34 and/or substrate 36. The reinforcement 50 can be secured by, for example, the joining methods outlined above for securing together the outer/perimeter edges 30/32 of the outer material 34. FIG. 4A illustrates the use of stitching 54 to secure the reinforcement 50 to the rear cover 16, in which case the stitching 54 can extend through both legs 52*b* of the strip 52, through both layers of the covering material 34, and through the substrate 36. It may be desired to directly couple the reinforcement 50 to the substrate 36 since the substrate 36 may be stiffer and/or stronger than the outer material 34.

The reinforcement 50 reinforces and/or protects the hinges 15/32 from loads, wear and abrasion, and also spans, bridges, and reinforces the hinges 15/32 by providing greater strength and resistance to separation forces. In this manner the reinforcement 50 reduces stresses, cracks and tearing in the hinges 15/32. The reinforcement 50 can also be considered to constitute part of the hinge 15/32, and indeed if desired portions of the hinge seal area 32, including portions underlying the reinforcement 50 could be removed, in which case the reinforcement 50 can be considered to form part of the hinge 15.

In an alternate embodiment, as shown in FIG. 4B, one of the legs 52*b* from the embodiment of FIG. 4A, and part of the base 52*a*, are omitted, and the strip 52 is generally L-shaped in cross section. In a further alternate embodiment, as shown in FIG. 4C, the strip 52 is generally linear in cross section, including only a single leg 52*b*. In further alternate embodiments the strip 52 may comprise only the other outer leg 52*b* than that shown in FIG. 4C and/or only the base 52*a*. The embodiments of FIGS. 4B and 4C may provide a materials savings and/or be easier to manufacture compared to the embodiment of FIG. 4A, but may in some cases provide less strength/reinforcement.

The reinforcement 50/strip 52 may be made of a relatively flexible/pliable material such that the strip 52 does not significantly inhibit the opening or closing of the bound component 10. For example, the strip 52 may be more flexible than the inner material 36, and in one case at least as flexible as the outer material 34. The reinforcement 50 may be made of a material that is stronger and/or more durable and/or tougher than the outer material 34. The reinforcement 50, when secured in place, may extend along the width of the front 12 and/or rear 16 covers (e.g. in a generally left-to-right direction along the top edge of the cover 12 in FIG. 3) a distance less than about the width of the spine 14 (e.g. in a generally up-and-down direction along the upper edge of the spine 14 in FIG. 3), or a distance of less than about ¼ of the width of the front 12 and/or rear 16 covers, or less than about 10% or about 15% of the length of a free edge of one of the covers 12, 16. In this manner the reinforcement 50 is positioned relatively close to the hinges 15/32, where the reinforcement is needed, and can provide a materials savings.

The strip 52 may extend along the height of the panels 12, 14, 16 (e.g. in a generally up-and-down direction along the direction of the hinge 15 in FIG. 3), by a distance of less than about three times, or less than about five times, the thickness of a panel 12, 14, 16, or less than about 10% of the height of a panel 12, 14, 16. This arrangement further ensures that the reinforcement 50 is positioned adjacent to the top/bottom of the hinges 15/32. In some cases, all other areas/edges of the panels 12, 14, 16 and/or hinges 15 lack the strip 52 and reinforcement 50. Although FIGS. 3-5 illustrate the reinforcement 50/strip 52 positioned at the top of the binder 10/spine 14, it should be understood that another reinforcement 50/strip 52 can be positioned at the opposite/bottom of the binder 10/spine 14.

Having described the inventions in detail herein, it will be apparent that modifications and variations thereof are possible without departing from the scope of the inventions. It is to be understood that the bound component modifications and variations discussed herein could be used interchangeably with the various bound components described throughout this application.

What is claimed is:

1. A bound component comprising:

a first panel and a second panel pivotally coupled together along a hinge, wherein each panel includes an outer covering and a substrate positioned in the outer covering, wherein the outer covering of the first panel is directly coupled to the outer covering of the second panel to form the hinge, and wherein the substrates of the first and second panels are not directly coupled together; and a one-piece reinforcement extending over or forming at least part of the hinge, wherein the one-piece reinforcement is a separate and discrete piece of material from each outer covering and each substrate, and wherein the reinforcement includes a first portion directly coupled to the first panel and a second portion directly coupled to the second panel, wherein the first and second panels each include a free edge positioned generally perpendicular to the hinge, an inner surface and an outer surface, and wherein the reinforcement extends from the inner surface of at least one of said panels, over the free edge of the at least one panel, to the outer surface of the at least one panel, and wherein said reinforcement is an outer-most component of said bound component.

2. The bound component of claim 1 wherein said hinge includes a pair of ends, and wherein the reinforcement is positioned only at one or both ends of said hinge.

3. The bound component of claim 1 wherein at least one panel includes a free edge extending generally perpendicular to the hinge, and wherein the reinforcement extends along less than about 15% of a length of the free edge.

4. The bound component of claim 1 wherein the reinforcement extends from the inner surface of each panel, over the free edge, to the outer surface of each panel.

5. The bound component of claim 4 wherein the reinforcement is generally "U" shaped in cross section.

6. The bound component of claim 4 wherein the reinforcement is coupled to both the inner surface and the outer surface of the first and second panels.

7. The bound component of claim 1 wherein the reinforcement extends generally perpendicular to the hinge.

8. The bound component of claim 1 wherein the reinforcement is directly coupled to the substrate.

9. The bound component of claim 1 wherein each substrate has a surface area equal to at least about 90% of the surface area of the associated panel.

10. The bound component of claim 1 wherein each substrate is entirely covered on all surfaces thereof by the associated outer covering.

11. The bound component of claim 1 further comprising a third panel pivotally coupled to the first panel along a supplemental hinge extending generally parallel to the hinge, wherein the third panel includes an outer covering and a substrate positioned in the outer covering, wherein the outer covering of the third panel is directly coupled to the outer covering of the first panel to form the supplemental hinge, and wherein the substrates of the first and third panels are not directly coupled together.

12. The bound component of claim 11 wherein the reinforcement extends over at least part of the supplemental hinge.

13. The bound component of claim 1 wherein the reinforcement extends for less than the entire length of the free edge of one of the panels.

14. The bound component of claim 1 wherein the reinforcement has a width extending perpendicular to the free edge, and wherein the reinforcement has a length extending parallel to the free edge, and wherein the width of the reinforcement is uniform along an entire length thereof.

15. The bound component of claim 14 wherein said width extends an entire dimension of the reinforcement from the inner surface of the least one of the inner panels, over the free edge of the at least one panel, to the outer surface of the at least one panel.

16. The bound component of claim 1 wherein the reinforcement extends over only a single free edge of each of the first and second panels.

17. The bound component of claim 1 wherein the first panel and the second panel each have a height dimension extending parallel to the hinge and wherein the reinforcement extends less than the height dimension of each of the panels.

18. The bound component of claim 1 wherein said first panel takes the form of a front or rear cover, and said second panel takes the form of a spine, and wherein the bound component further includes a third panel pivotally coupled to said spine, said third panel having generally the same size and shape as said first panel.

19. The bound component of claim 18 wherein said reinforcement extends along only part of the free edge of the first panel, along an entirety of the free edge of the second panel, and along only part of a free edge of the third panel.

20. A bound component comprising:

a first panel and a second panel pivotally coupled together along a hinge, the first panel and the second panel each having a height dimension extending parallel to the hinge and a free edge positioned generally perpendicular to the hinge, wherein the first and second panels each further include an inner surface and an outer surface; and a one-piece reinforcement coupled to the first and second panels, the one-piece reinforcement extending over or forming at least part of the hinge, the reinforcement extending for less than an entire length of the free edge of at least one of the panels and extending in a direction parallel to the hinge less than the associated height dimension, wherein the reinforcement extends from an inner surface of each panel, over the free edge, to the outer surface of the associated panel, and wherein said reinforcement is an outer-most component of said bound component.

21. The bound component of claim 20 wherein each panel includes an outer covering and a substrate positioned in the outer covering, wherein the outer covering of the first panel is directly coupled to the outer covering of the second panel to form the hinge, and wherein the substrates of the first and second panels are not directly coupled together.

22. The bound component of claim 20 wherein the reinforcement is a separate and discrete piece of material from each outer covering and each substrate.

23. The bound component of claim 20 wherein the reinforcement extends along less than about 15% of a length of the free edge of at least one of the first or second panels.

24. The bound component of claim 20 wherein the reinforcement extends over only a single free edge of each panel.

25. A bound component comprising:

a first panel and a second panel pivotally coupled together along a hinge, wherein each panel includes an outer covering and a substrate positioned in the outer covering, wherein the outer covering of the first panel is directly coupled to the outer covering of the second panel to form the hinge, and wherein the substrates of the first and second panels are not directly coupled together; and a one-piece reinforcement extending over or forming at least part of the hinge, wherein the one-piece reinforcement is a separate and discrete piece of material from each outer covering and each substrate, and wherein the reinforcement includes a first portion directly coupled to the first panel and a second portion directly coupled to the second panel, wherein the first and second panels each include a free edge positioned generally perpendicular to the hinge, an inner surface and an outer surface, and wherein the reinforcement extends from the inner surface of at least one of said panels, over the free edge of the at least one panel, to the outer surface of the at least one panel, and wherein said reinforcement is directly coupled to an outer surface of said outer covering of said first and second panels.

* * * * *